United States Patent [19]

Richardson et al.

[11] Patent Number: 4,678,353

[45] Date of Patent: Jul. 7, 1987

[54] TAPE SUPPLY CARTRIDGE

[75] Inventors: Michael M. Richardson, Scottsdale, Ariz.; Douglas A. Schaffer, Inver Grove Heights, Minn.

[73] Assignee: Kroy Inc., St. Paul, Minn.

[21] Appl. No.: 790,111

[22] Filed: Oct. 22, 1985

Related U.S. Application Data

[62] Division of Ser. No. 549,261, Nov. 4, 1983, Pat. No. 4,557,617.

[51] Int. Cl.[4] ..... B41J 32/00; B41J 35/36; B41J 35/04

[52] U.S. Cl. ..... 400/248; 400/134.6; 400/208; 400/219.1

[58] Field of Search ..... 400/219.1, 236.1, 208, 400/249, 613, 248, 618, 134.4–134.6

[56] References Cited

U.S. PATENT DOCUMENTS

| | | | |
|---|---|---|---|
| 3,311,209 | 3/1967 | Pedersen | 400/249 |
| 3,889,893 | 6/1975 | Silverman et al. | 400/219.1 |
| 3,897,867 | 8/1975 | Shattuck et al. | 400/236.1 |
| 4,043,440 | 8/1977 | Busch | 400/618 |
| 4,115,013 | 9/1978 | Hedstrom | 400/249 |
| 4,226,547 | 10/1980 | Bradshaw et al. | 400/613 |
| 4,260,271 | 4/1981 | Kondur, Jr. | 400/236.1 |
| 4,391,539 | 7/1983 | Connoy | 400/134.6 |
| 4,402,619 | 9/1983 | Paque et al. | 400/36 |

*Primary Examiner*—William Pieprz
*Attorney, Agent, or Firm*—Dorsey & Whitney

[57] ABSTRACT

A tape supply cartridge for supplying tape and ribbon to a lettering apparatus having a mechanism for creating a lettering force and a mechanism for positioning a character to be lettered into lettering position. The cartridge includes an improved device for advancing and assuring alignment of the tape and an improved mechanism for interfacing and aligning the cartridge with respect to the lettering machine.

11 Claims, 19 Drawing Figures

TAPE SUPPLY CARTRIDGE

BACKGROUND OF THE INVENTION

The present invention relates generally to an improved tape supply cartridge for use with a lettering apparatus or type composing system, and more particularly, to a tape supply cartridge for housing a supply of lettering tape and supplying the same to a lettering station in the above-mentioned apparatus. In the preferred embodiment, the cartridge also includes a supply of lettering ribbon and means for advancing the same toward the lettering station. Further features of the present invention include an improved tape and ribbon advancement and alignment means, an improved means preventing free wheeling of the ribbon supply and improved means for interfacing the cartridge with the apparatus.

Typical prior art printing apparatus and type composing systems including tape supply cartridges therefor are described in U.S. Pat. Nos. 3,834,507, 3,912,064, 4,015,700, 4,226,547, 4,243,333 and 4,402,612. Each of the machines described in these patents includes a printing or lettering station, a raised character positionable into alignment at such station, means for providing a printing or lettering force and means associated with the cartridge for appropriately advancing the tape and ribbon. Although the prior tape supply cartridges function satisfactorily in many applications, the cartridge of the present invention embodies several improved features. These features include an improved means for supplying and advancing the tape and ribbon to the lettering station for proper alignment, improved means preventing free wheeling of the ribbon supply and various improved means for interfacing the cartridge with the apparatus.

SUMMARY OF THE INVENTION

The tape supply cartridge of the present invention is adapted for use in a lettering apparatus of the general type having a lettering station, means for providing a raised character or the outline of a character in alignment with such station and a means for creating a force to transfer an image of the raised character to the tape or to cut out a character in the shape of said outline from the tape. More specifically, the cartridge of the present invention includes a housing embodying a portion containing a supply of tape and ribbon. Means are provided in the form of an improved shuttle assembly for advancing the tape and ribbon from the supply portion of the housing to the lettering station. This shuttle assembly includes means in the form of a rocker mechanism for increasing the gripping force on the tape during advancement of the tape toward the station and means for releasing such force as the shuttle assembly is moved rearwardly. The rocker mechanism interfaces with an appropriate drive arm on the apparatus and insures a much quicker and more accurate tape advancement. Means are also provided for improving the alignment of the tape and ribbon and for guiding the tape and ribbon into alignment with the lettering station. This means includes tape and ribbon guide elements which interface with appropriate portions of the machine to permit centering of the tape and ribbon with respect to the machine rather than the supply cartridge.

The cartridge of the present invention also includes ribbon rewind means for rewinding spent ribbon in a plane which is common with the ribbon supply. This ribbon rewind feature includes a ribbon rewind spool and a pair of clutch members for permitting rotation of the ribbon rewind spool in one direction only. The ribbon rewind means also includes means for driving the ribbon rewind spool as a result of reciprocal movement of the shuttle assembly. The cartridge of the present invention also includes improved means associated with the ribbon supply spool to prevent the same from free-wheeling or unwinding due to vibrations or movement of the cartridge. This means includes a ratchet mechanism which is released as tension is placed on the ribbon during rewinding, but which engages the ribbon supply spool when such tension is released. The cartridge also includes an opening in its bottom edge facilitating the sensing of the amount of tape remaining in the cartridge and various other interface features which permit the cartridge to be properly aligned within the apparatus.

"The cartridge of the present invention further includes an improved means for aligning the tape for advancement to the printing station of the apparatus. This means includes a tape guide portion having a tab extending laterally outwardly past a side surface of the cartridge for reference engagement with a portion of the apparatus."

Accordingly, it is an object of the present invention to provide an improved tape supply cartridge having improved means for advancing the tape toward the lettering station.

Another object of the present invention is to provide a tape supply cartridge having an improved means for guiding and insuring alignment of the tape with respect to the lettering station.

Another object of the present invention is to provide a tape supply cartridge having means for facilitating the sensing of the amount of tape remaining in the cartridge.

These and other objects of the present invention will become apparent with reference to the drawing, the description of the preferred embodiment and the appended claims.

DESCRIPTION OF THE PREFERRED EMBODIMENT

Figures 1, 1A, 1B, 2, 3:
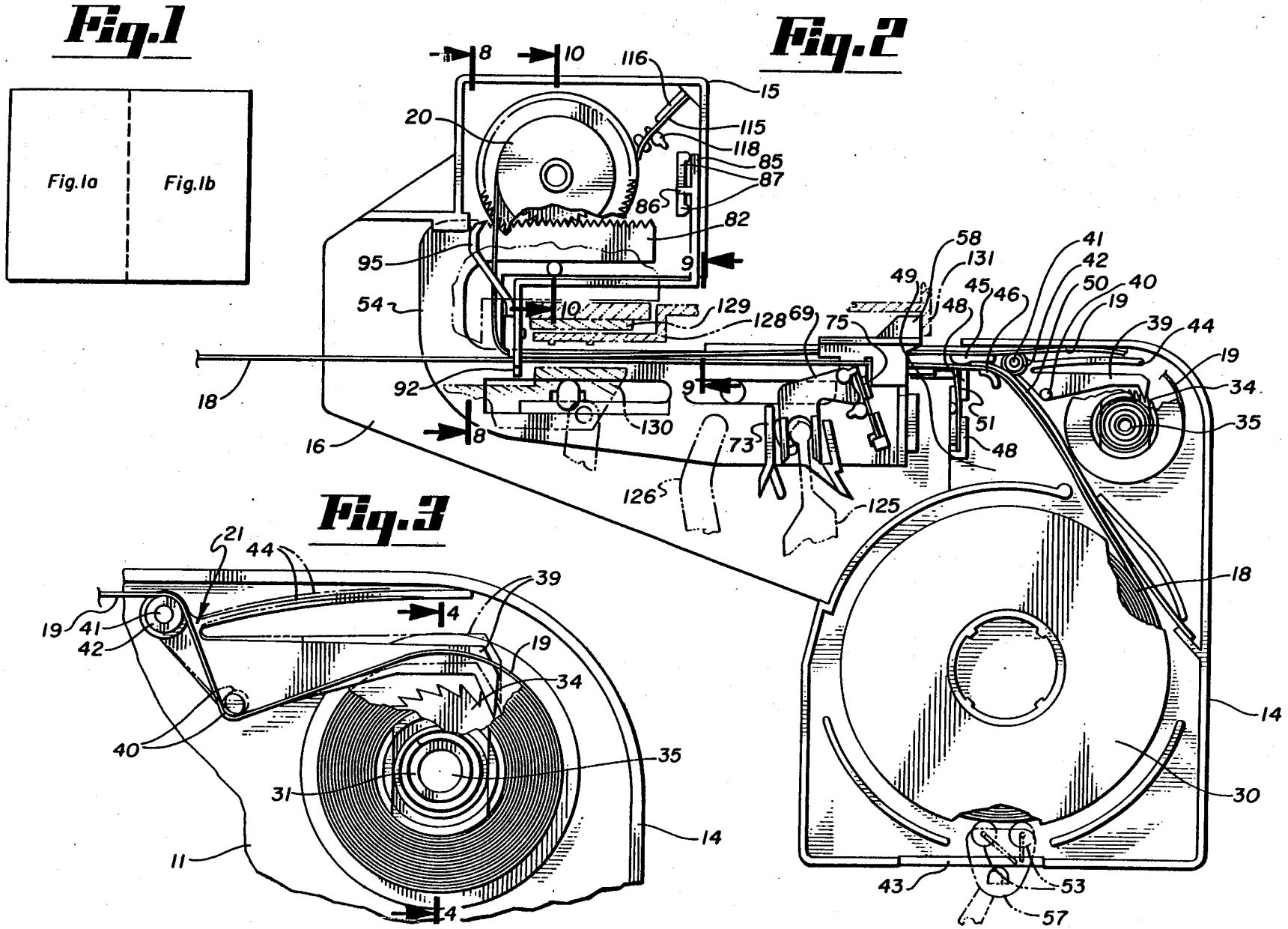
FIG. 1, comprised of FIGS. 1*a* and 1*b*, is an exploded, pictorial view of the tape supply cartridge of the present invention.
FIG. 2 is an elevational side view of the inside of the tape supply cartridge of the present invention with one side of the housing removed.
FIG. 3 is an elevational side view, with portions broken away, showing the ribbon supply spool and the ratchet means for preventing free-wheeling thereof.
Figure 1A:
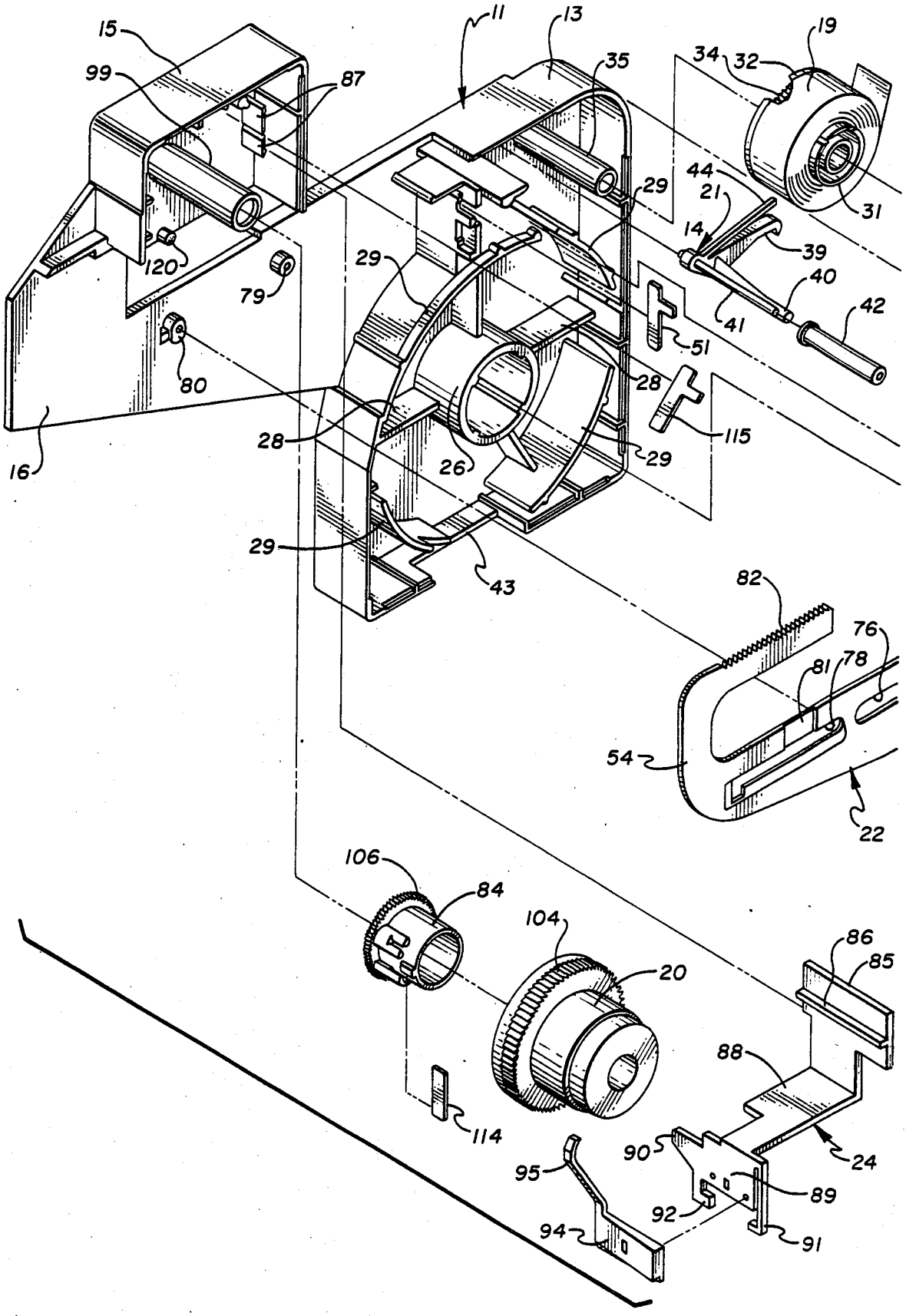
Figure 1B:
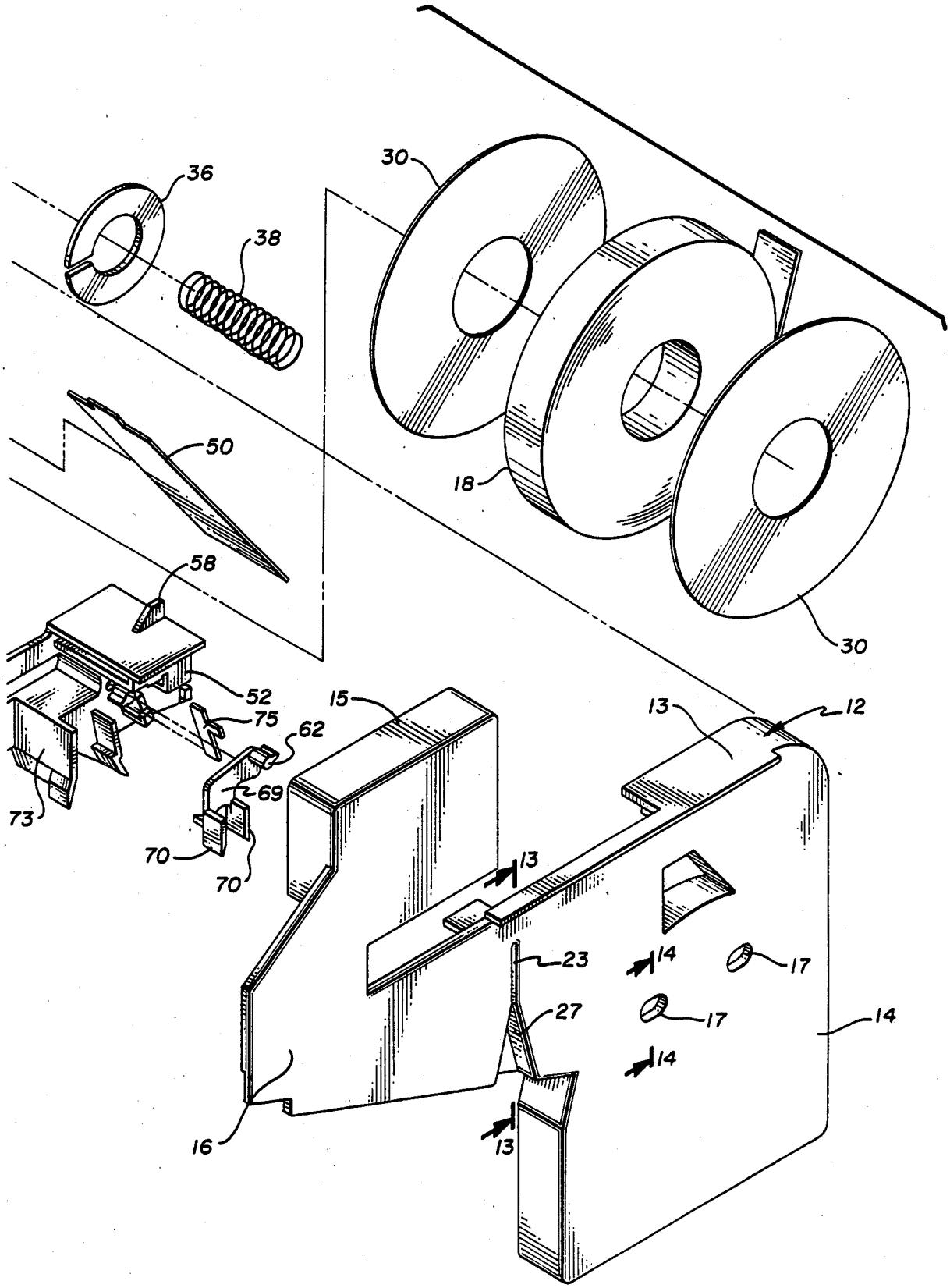

Reference is first made to FIGS. 1 and 2 in which the tape supply cartridge of the present invention is shown in both an exploded (FIG. 1) and an assembled (FIG. 2) form. The cartridge includes a cartridge housing comprised of a pair of side housing sections 11 and 12. Each of the housing sections 11 and 12 includes a rearwardly disposed tape and ribbon supply portion 14 for housing a supply of tape 18 and ribbon 19, a forwardly disposed ribbon rewind portion 15 for housing a ribbon rewind spool 20 and related structure and a sidewall connecting portion 16 joining the tape and ribbon supply portion 14 with the ribbon rewind portion 15. The housing also includes a peripheral edge 13 to enclose the portions 14 and 15 when assembled.

Housed within the cartridge is a supply of lettering tape 18 and ribbon 19, a means in the form of the ratchet mechanism 21 to preclude free-wheeling of the ribbon supply spool 19, means in the form of a shuttle assembly 22 for advancing the tape and ribbon into alignment with the lettering station, means in the form of the tape and ribbon guide member 24 for guiding and properly aligning the tape and ribbon with respect to the lettering station and a means for rewinding spent ribbon onto the rewind spool 20.

With continuing reference to FIGS. 1 and 2, each of the cartridge side housing sections 11 and 12 includes a central support post 26 for rotatably supporting the supply of tape 18. Extending generally radially outwardly from the center post 26 are a plurality of tape support vanes 28 which function to retain the supply of tape 18 properly positioned within the cartridge. It should be noted that the width of the vanes 28 will vary to accommodate various widths of tape 18. Although not specifically illustrated, the inside of the cartridge housing section 12 includes a central tape support post and a plurality of radially extending tape support vanes similar to those shown in the housing section 11. Disposed about a portion of the periphery of the tape supply 18 are a plurality of curved sections 29 which also function to help retain the tape supply 18 within the cartridge and to maintain the same in a relatively circular configuration. The cartridge housing section 12 includes similar portions 29. Disposed on each side of the tape supply 18 is a disc member 30 which has a tack surface on the side facing the tape supply 18. The primary functions of the discs 30 are to prevent the tape supply 18 from free-wheeling or unrolling due to vibrations or movements of the cartridge, to protect the side edges of the tape and to maintain the supply of tape in a generally circular configuration.

As shown best in FIG. 1, the left side housing section 12 includes a recessed cartridge alignment slot 23 to mate and interface with an indexing or alignment tab 37 (FIG. 13) on the machine. A generally v-shaped entrance or lead-in ramp 27 is also provided to guide the indexing tab 37 into engagement with the slot 23. The relationship between the slot 23 and indexing tab 37 is illustrated best in FIG. 13 which shows the tab 37 extending through an opening in the forward frame member 33 of the machine and into the slot 23.

Figure 13:
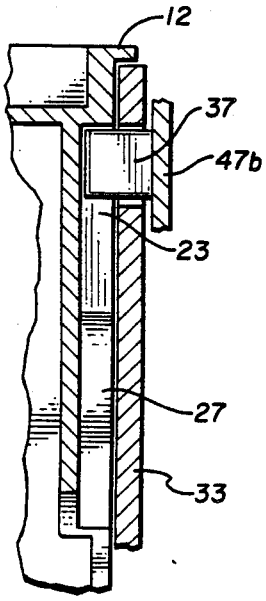
FIG. 13 is a view, partially in section, as viewed along the section line 13—13 of FIG. 1, with parts added.
Figure 14:
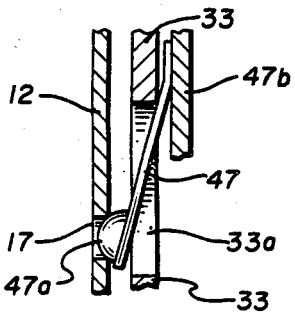
FIG. 14 is a view, partially in section, as viewed along the section line 14—14 of FIG. 1, with parts added.

The left side housing section 12 also includes a pair of alignment openings 17, 17 for engagement by a pair of corresponding, spring biased index elements 47*a*. As shown in FIG. 14, the elements 47*a* are carried by a section 47 of the spring steel or similar material. The spring section 47 is secured at its upper end to a portion of a kerning slide 47*b* and extends downwardly through an opening 33*a* in the frame member 33 to permit engagement between the elements 47*a* and the openings 17, 17. As a result of such engagement and the spring 47, the cartridge is biased toward the opposite side of the cartridge receiving cavity. In the preferred embodiment, such cavity is defined by the frame members 98 (FIGS. 8 and 9) and 33 (FIGS. 13 and 14).

Figure 16:
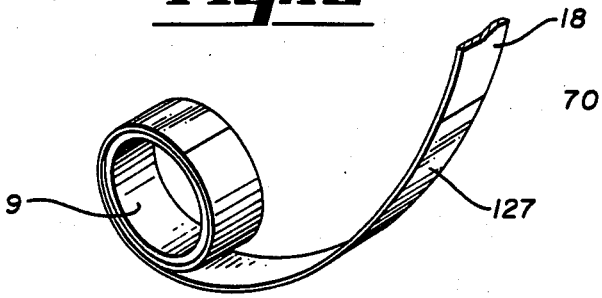
FIG. 16 is a pictorial view showing the end of the tape supply spool.

The bottom of the tape supply supply portion 14 of the cartridge is provided with an access opening 43 to permit access by a tape sensing mechanism 57 as illustrated in FIG. 2. The mechanism 57 includes a pair of rollers 53, 53 which ride against the tape supply 18. The mechanism 57 is connected with a lever arm for indicating the amount of tape 18 remaining in the cartridge. As the tape 18 is used up, the mechanism 57 moves upwardly as viewed in FIG. 2, thereby causing corresponding movement of a connection linkage to reflect remaining tape supply. In the preferred embodiment, the mechanism carries a pair of metal rollers 53, 53 for engagement with the tape supply. These rollers are connected with appropriate electrical means for causing an audio or visual signal if electrical contact is bridged between the rollers 53, 53. As shown in FIG. 16, the tape 18 is supported on a spool 9. The end of the tape is provided with a metal foil layer 127. As the tape supply nears its end, the rollers 53, 53 will engage the foil 127 and result in electrical connection between the rollers 53, 53. This in turn causes a visual or audio signal indicating to the user that he or she only has a few inches of tape remaining.

Figure 4:
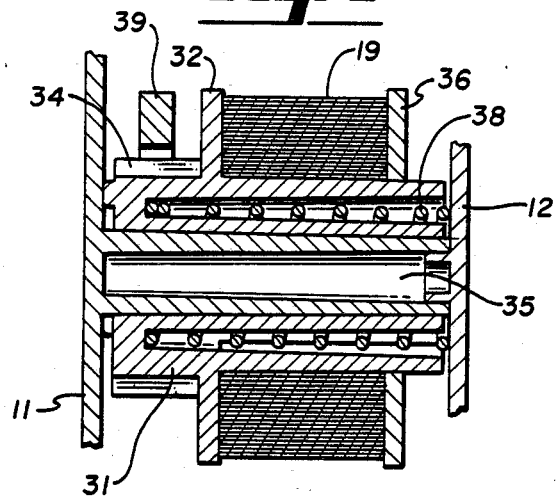
FIG. 4 is a view, partially in section, of the ribbon supply spool and ratchet means as viewed along the section line 4—4 of FIG. 3, with the left side housing section added.

As illustrated generally in FIGS. 1 and 2 and more specifically in FIGS. 3 and 4, the ribbon supply 19 is wound onto a support spool 31 which is integrally joined with a side flange portion 32. Also integrally joined with the spool 31 is a rearwardly disposed ratchet portion 34 having a plurality of ratchet teeth disposed about its periphery. A washer 36 is adapted to be press-fit onto the opposite end of the spool 31. The spool 31 includes an interior cylindrical opening which permits the ribbon supply 19 and associated supporting structure to be mounted for rotational movement on the support post 35. The post 35 is integrally formed with the housing section 11. When disposed between the housing sections 11 and 12 as illustrated best in FIG. 4, the outer end of the support post 35 mates with a correspondingly located circular flange on the inside surface of the housing section 12. A coil spring 38 is disposed in an annular opening in the spool 31 to maintain the ribbon supply 19 in a position biased against the housing section 11 and to assist in preventing the ribbon supply 19 from freely unwinding.

Additional means are provided for preventing the supply of ribbon 19 from unwinding in the form of the ratchet mechanism 21. As illustrated best in FIGS. 1, 2 and 3, the ratchet mechanism 21 includes an elongated, rearwardly extending ratchet arm 39 having a tooth at its outer end for selective engagement with the teeth in the ratchet member 34. Extending outwardly from the forward end of the ratchet arm 39 and in a direction generally parallel to the support post 35 is a ribbon guide member 40. The ratchet mechanism 21 also includes a spring member in the form of a rearwardly extending flexible member 44 which is positioned so that its rearwardmost end is in engagement with the top, inner edge of the housing section 11. The entire ratchet mechanism 21 is supported between the housing sections 11 and 12 in rotational relationship by the post 41 which extends into small openings in the side walls of the housing sections 11 and 12. A roller or sleeve member 42 is disposed around the post 41 to permit the ribbon 19 to move freely through the ratchet mechanism 21.

The principal function of the ratchet mechanism 21 is to prevent the supply of ribbon 19 from free-wheeling or unwinding from the spool due to vibrations or movements of the cartridge. This is done as a result of engagement between the ratchet tooth of the rearward end of the ratchet arm 39 and one of the ratchet teeth in the ratchet member 34. This is shown best in FIG. 3. The ratchet arm 39 is retained in this engaged position as a result of the spring action caused by the flexible member 44 acting on the inside surface of the housing section 11. The ratchet arm 39 is released, however, when tension is placed on the ribbon 19. As a force is exerted on the ribbon 19 such as by pulling it toward the left in FIG. 3, the ribbon causes upward movement of the post 40 to the position illustrated by the broken line against the force of the flexible member 44. This similarly causes upward movement of the ratchet arm 39 to the position of the broken line, thus disengaging the ratchet teeth and permitting the ribbon 19 to be fed from the ribbon spool. After leaving the ribbon supply spool 31, the ribbon 19 is directed past the tape clutch post 45 (FIG. 2) and through various guide openings in the shuttle assembly 22 and the tape guide means 24.

After leaving the tape supply spool, the tape 18 is guided by the paper divider 50 and by various structural elements integrally formed with the cartridge housing sections 11 and 12 to the shuttle assembly 22. Specifically, the tape 18 is directed above a guide post 46 formed in each of the housing sections 11 and 12 and then between the bias member 51 and the means in the form of the clutch post 45 for resisting the force of the bias member 51. In the preferred embodiment, the bias member 51 is a leaf spring which is supported by the surface 49 and retained by three retaining elements 48 integrally formed on the surface 49. The clutch post 45 is integrally formed with the inside surface of the housing section 11 and extends outwardly therefrom at right angles. The top surface of the clutch post 45 is generally flat to support the ribbon 19 as it is directed toward the shuttle assembly 22. It should be noted that the leaf spring 51 is prestressed toward the left as viewed in FIG. 2 to permit the tape 18 to be advanced toward the left relative to the cartridge housing, but to prevent movement of the tape 18 toward the right. If an attempt is made to move the tape 18 toward the right as viewed in FIG. 2, the outer edge of the leaf spring 51 digs into the underside of the tape 18 and precludes such movement.

Figure 6:
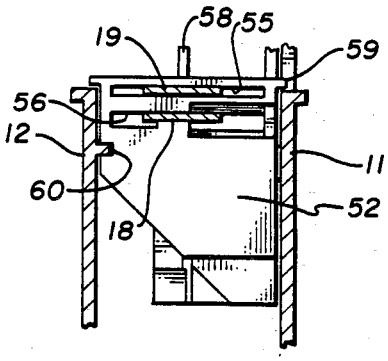
FIG. 6 is a view, partially in section, as viewed along the section line 6—6 of FIG. 5, with the left side housing section added.
Figure 5:
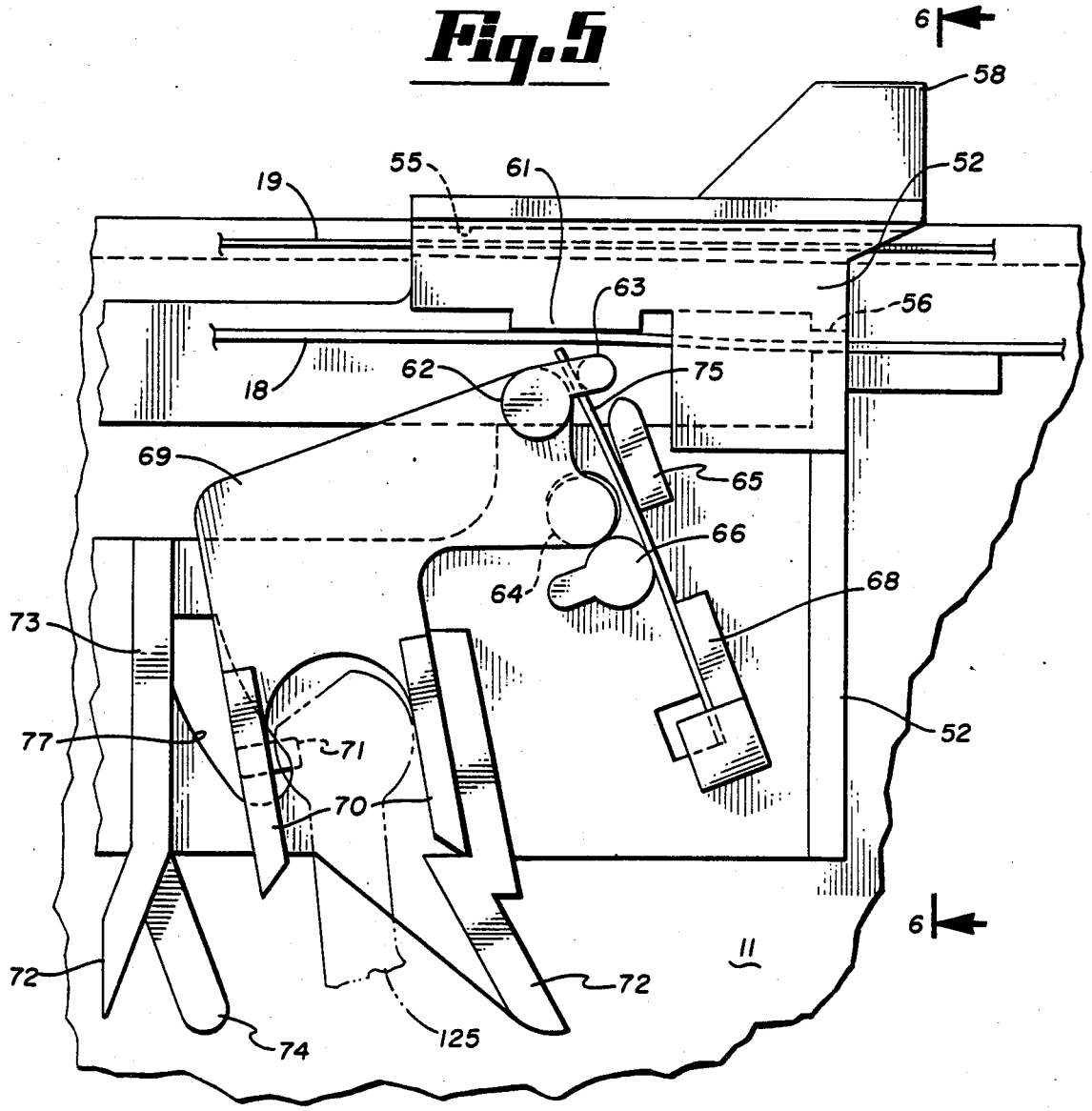
FIG. 5 is an enlarged elevational side view of a portion of the shuttle assembly showing the rocker mechanism and leaf spring in a released position.
Figure 7:
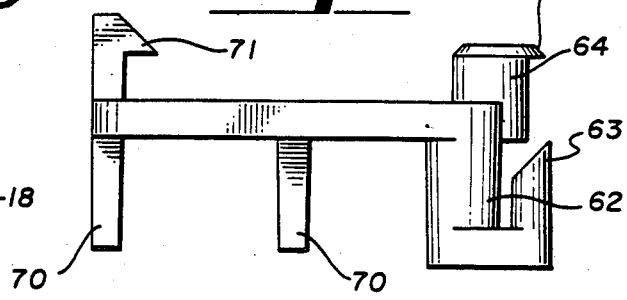
FIG. 7 is a top elevational view of the rocker mechanism which forms a part of the shuttle assembly.

The shuttle assembly 22 is illustrated generally in FIGS. 1 and 2 and more specifically in FIGS. 5, 6 and 7. The shuttle assembly 22 includes a rearwardly disposed tape and ribbon guide portion 52 which includes means in the form of the guide slots 55 and 56 (FIG. 6) for guiding the ribbon 19 and the tape 18, respectively, along a path toward the lettering station. Means are also provided for gripping the tape 18 and advancing the same toward the lettering station and means in the form of the forwardly extending support and slide arm 54. The arm 54 is slidably connected with the inner side wall of the housing section 11 to permit the shuttle assembly 22 to be moved reciprocally between forward and rearward positions.

With reference to FIG. 6, an upper flange 59 is positioned immediately above the vertically spaced-guide slots 55 and 56. The flange 59 includes edge portions extending laterally outwardly from the main body portion 52 for supporting and guiding the shuttle assembly 22 along the top edge of the housing sections 11 and 12. The left side of the portion 52 as viewed in FIG. 6 includes a further guide portion in the form of the recessed area 60 which mates with a corresponding rib on the inside surface of the housing section 12. A spacing tab 58 is connected with the top surface of the member 59 and is adapted for engagement with a spacing ring 131 located on the machine font 128 (FIG. 2) in a manner known in the art.

With reference to FIG. 5, the rearward guide portion 52 also includes a bias resisting portion 61 and a plurality of leaf spring support members 65, 66 and 68 for supporting and prestressing a leaf spring member 75 in the position illustrated. Specifically, one side edge of the leaf spring 75 is supported by the side surface of the portion 52 while the opposite side edge of the leaf spring 75 is retained by a portion of the member 68 and an overhanging portion 63 of the rocker arm retaining post 62. It should be noted that the leaf spring 75 as viewed in FIG. 5 is prestressed toward the left. Thus, it functions to permit forward movement of the tape 18 toward the left relative to the shuttle assembly, and to preclude rearward movement of the tape 18 toward the right relative to the shuttle assembly.

The shuttle assembly includes a rocker mechanism 69 which functions to increase the force of the leaf spring 75 against the bottom surface of the tape 18 when the shuttle is being advanced, and to release the force of the spring 75 from the tape 18 when the shuttle is moved rearwardly. The rocker mechanism 69 is pivotally secured with respect to the portion 52 by the pivot post 64. As shown best in FIG. 7, the pivot post 64 includes a small outwardly extending flange portion 67 which locks into an opening in the portion 52 to prevent the rocker mechanism 69 from being inadvertently dislodged from its operational position. A second retaining post 71 is connected with a side of the rocker mechanism 69 and extends through an arcuate opening 77 (FIG. 5) in the portion 52. As illustrated best in FIG. 7, the retaining post 71 also includes an outwardly extending tab for retaining the rocker mechanism 69 adjacent to the surface of the portion 52.

Figure 5A:
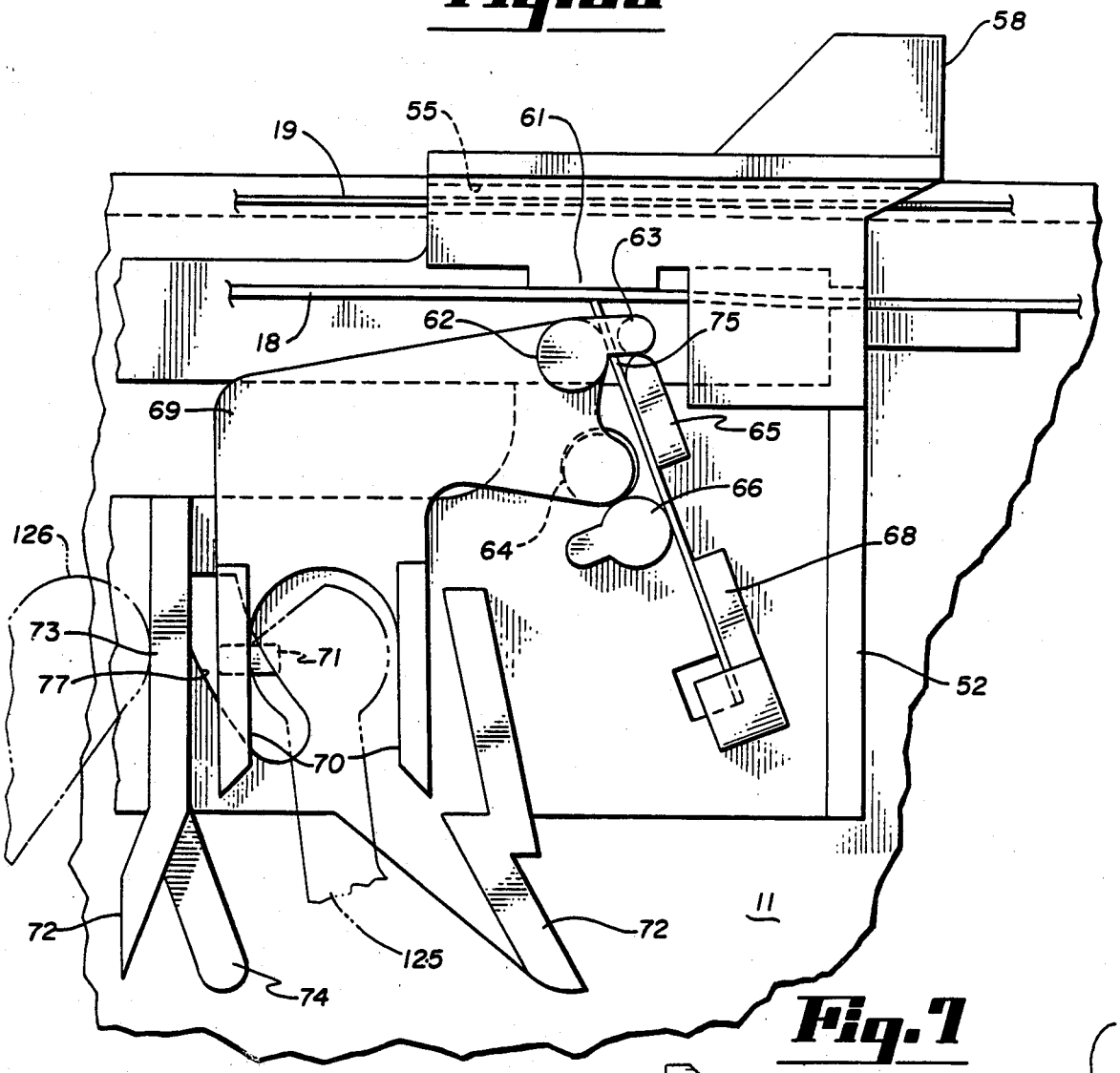
FIG. 5*a* is an enlarged elevational side view of a portion of the shuttle assembly showing the rocker mechanism and leaf spring in a gripping position.

The rocker mechanism 69 also includes a pair of outwardly extending, forward and rearward drive surfaces or tabs 70, 70. These tabs 70, 70 are spaced apart from one another and define a drive arm receiving cavity for receiving a mating drive arm 125 from the machine into which the cartridge is inserted. As illustrated in FIGS. 2 and 5, the drive arm 125 is inserted into the receiving cavity between the drive tabs 70, 70 and functions to pivot the rocker mechanism 69 about the pivot 64 and to advance and retract the entire shuttle assembly. During forward movement of the drive arm 125, the rocker mechanism 69 is first pivoted in a generally clockwise direction as viewed in FIG. 5 about the pivot 64. This initial clockwise movement will cause the post 62 to press the leaf spring 75 more tightly against the bottom surface of the tape 18, thus increasing the gripping force between the leaf spring 75 and the tape 18. Following initial clockwise rotation of the rocker mechanism 69, further forward movement of the drive arm 125 results in the entire shuttle assembly being moved in a forward direction. Because of the gripping force between the leaf spring 75 and the tape 18, the tape 18 will be advanced forwardly along with the shuttle assembly. The position of the rocker mechanism 69 during this forward movement is illustrated in FIG. 5. After reaching its forwardmost advancement as permitted by engagement between the stop surface 73 and the stop arm 126, and upon commencement of a lettering cycle, the drive arm 125 moves rearwardly. Initial rearward movement of the drive arm 125 results in initial counterclockwise movement of the rocker mechanism 69 about the pivot 64 to the position illustrated in FIG. 5*a*. This movement causes the force of the leaf spring 75 acting against the tape 18 to be released as a result of engagement between the spring retaining flange 63 and the leaf spring 75. Upon further rearward movement of the drive arm 125, the entire shuttle assembly 22 moves rearwardly. However, because of the existence of the clutch member 51 (FIG. 2), the tape 18 will remain stationery with respect to the cartridge housing.

As shown best in FIGS. 1, 2 and 5, the shuttle assembly 22 also includes a pair of guide tabs 72, 72 which function to guide the drive arm 125 into engagement with the drive arm cavity between the drive tabs 70, 70. A guide tab 74 insures the guiding of the apparatus stop arm 126 (FIG. 2) into its operative position against the stop surface 73 (FIGS. 1 and 2). The stop arm 126 functions to limit the forward movement of the shuttle assembly and therefore defines the forwardmost advancement of the tape 18. In the preferred embodiment, the drive arm 125 and stop arm 126 are disposed in generally side-by-side relationship.

The forward end of the shuttle assembly 22 includes the support and slide arm 54. A pair of elongated guide and support slots 76 and 78 are located in the arm 54 and designed to slide along the support and guide posts 79 and 80, respectively. The posts 79 and 80 are integrally connected with the inside surface of the housing section 11. It should be noted that the support post 80 includes a small downwardly extending flange portion which functions to retain the arm 54 closely adjacent to the inside surface of the housing section 11. Disposed in a portion of the arm 54 is a recessed section 81 which is designed to mate with a portion of the tape and ribbon guide assembly 24 to insure that the shuttle assembly will remain in a forward position when the cartridge is removed from the machine. Extending upwardly and rearwardly from the forward end of the support and guide arm 54 is a means for driving the ribbon rewind spool 20 as a result of movement of the shuttle assembly 22. This means is in the form of a movement transfer arm 82 which includes a plurality of ratchet teeth along its upper edge for corresponding engagement with ratchet teeth on the ribbon rewind member 84.

Reference is next made to FIGS. 1, 2, 8 and 9 illustrating the tape and ribbon guide means 24. The means 24 includes a rearward portion 85 having a laterally extending rib 86 which is adapted to mate with corresponding tab portions 87, 87 disposed within the ribbon rewind housing portions 15 of the housing sections 11 and 12. These tabs 87, 87 in conjunction with the portion 85 and rib 86 retain the guide means 24 in a fixed position with respect to the cartridge housing. The guide means 24 also includes a forwardly extending portion 88 which extends forwardly from a bottom edge of the portion 85 and is integrally joined with a tape guide element 89. The tape guide element 89 extends downwardly from the portion 88 at generally right angles and includes a tape guide tab 92 on one side for supporting and guiding the tape 18 in proper alignment with the lettering station. An elongated, flexible member 91 having an inwardly extending portion at its lower end extends downwardly from the element 89 for supporting and guiding the other edge of the tape 18. The manner in which the elements 91 and 92 support and guide the tape 18 is illustrated best in FIGS. 8 and 9. It should be noted that the normal distance between the guide portion of the tab 92 and the member 91 in its unstressed position is slightly less than the width of the tape 18 which is being used in the cartridge. Thus, when the tape is fed between the guide portions 92 and 91, a slight force is exerted by the member 91 against the side of the tape, thereby retaining the tape 18 in constant engagement with the guide portion 92. As shown in FIG. 2, the bottom edge of the tab 92 is supported by a portion of the force generating means 130 and moves upwardly and downwardly with the means 130 during a printing or lettering cycle.

Figure 8:
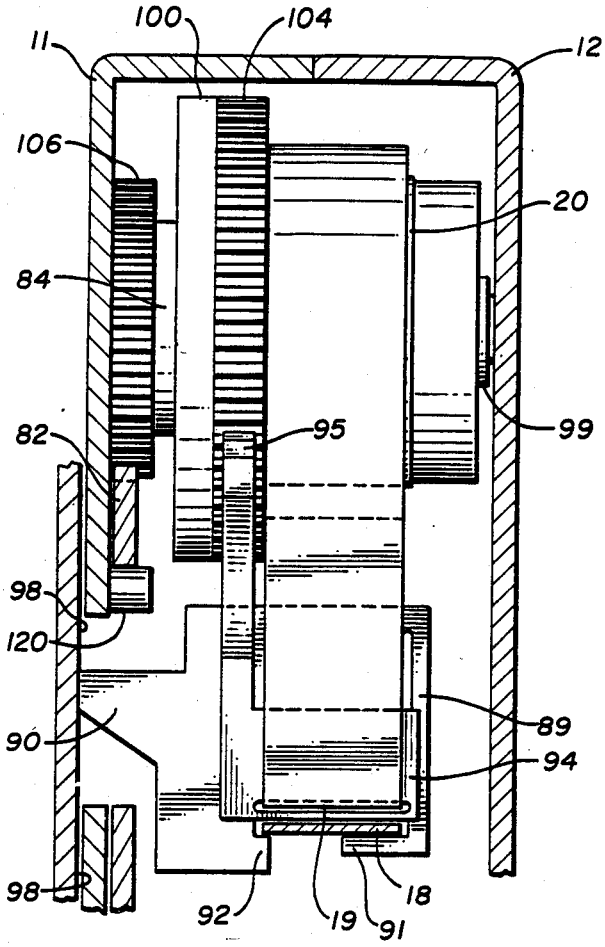
FIG. 8 is a view, partially in section, of the tape-ribbon guide and alignment means as viewed along the section line 8—8 of FIG. 2, with the left side housing section added and the cartridge inserted within the apparatus.
Figure 9:
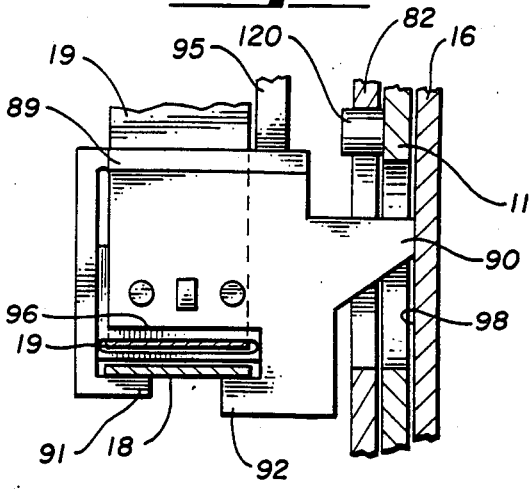
FIG. 9 is a view, partially in section, of the tape supply guide and alignment means as viewed along the section line 9—9 of FIG. 2, with a frame member of the apparatus added.
Figure 15:
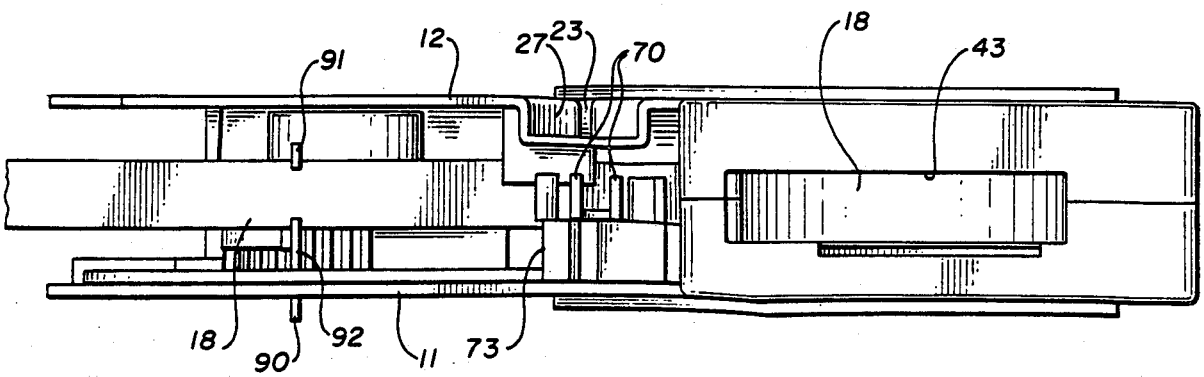
FIG. 15 is an elevational bottom view of the cartridge.

Positioned forwardly of the tape guide element 89 and connected thereto is a ribbon guide member 94. As illustrated best in FIGS. 8 and 9, the ribbon guide member 94 includes a ribbon guide slot 96. Integrally connected with the ribbon guide member 94 is an upwardly extending ratchet drive arm 95. The ratchet drive arm 95 is adapted for engagement with corresponding ratchet teeth on a portion of the ribbon rewind spool 20. This results in rotation of the spool 20 as a result of upward movement of the forward end of the tape and ribbon guide member 24 caused by engagement between the tab 92 and a portion of the force means 130. Such rotation is necessary when narrow tapes are being used to increase the passage of ribbon 19 through the system The tape and ribbon guide member 24 also includes a centering tab 90 which is integrally formed with the portion 89. In its normal, pre-stressed position, the tab 90 extends outwardly past the outer surface of the housing section 11 as shown in FIG. 15. In this position, the outer edge of the downwardly extending guide tab 92 engages the recessed portion 81 on the inner surface of the support and slide member 54 to keep the shuttle assembly in its forward position when the cartridge is out of the machine. When the cartridge is inserted into the machine, the indexing or centering tab 90 contacts the rear frame member 98 as shown in FIG. 8, thereby causing the tab 90 and thus the entire tape and ribbon guide means to move inwardly. This results in the tape being accurately positioned in lettering alignment with respect to the frame of the apparatus.

After passing through the ribbon guide portion 94, the ribbon 19 is directed upwardly into the ribbon rewind housing 15 where it is rewound onto a ribbon rewind spool 20. As illustrated best in FIGS. 1, 2, 10, 11 and 12, the spool 20 is mounted for rotational movement with respect to the post 99 integrally formed with the inside surface of the housing section 15 an extending perpendicular thereto. The rewind spool 20 includes a generally cylindrical portion 101 having an inner cylindrical surface of a size permitting it to rotate freely on the post 99. The spool 20 also includes an outer and lower flange portion 100 extending about its lower peripheral edge for engagement by one end of a leaf spring member 115 (FIG. 2). The leaf spring 115 is supported and retained within the housing section 15 by the spring retaining members 116 and 118. As shown, the leaf spring 115 is positioned to engage the outer flange 100 to permit it to be rotated in only a clockwise direction as viewed in FIG. 2. Thus, the leaf spring member 115 functions as a one way clutch to permit rotation of the spool 20 only in a direction to rewind spent ribbon.

Located between the ribbon supporting portion of the spool 20 and the inner cylindrical member 101 is an annular space for receiving a generally cylindrical portion of a ribbon rewind clutch member 84. The clutch member 84 includes a cylindrical portion 108 which is disposed outside the cylindrical portion 101 and which extends upwardly from the generally cylindrical base portion 105. The base 105 has an inner cylindrical opening which permits it to rotate freely on the post 99. The cylindrical portion 108 is disposed within the annular opening between the ribbon supporting portion 20 and the cylindrical section 101. Insertion of the cylindrical portion 108 is limited as a result of engagement between the end of the section 101 and the base portion 105. The base 105 has a plurality of ratchet teeth 106 positioned about its periphery for engagement with the ribbon rewind drive arm 82.

Figure 10:
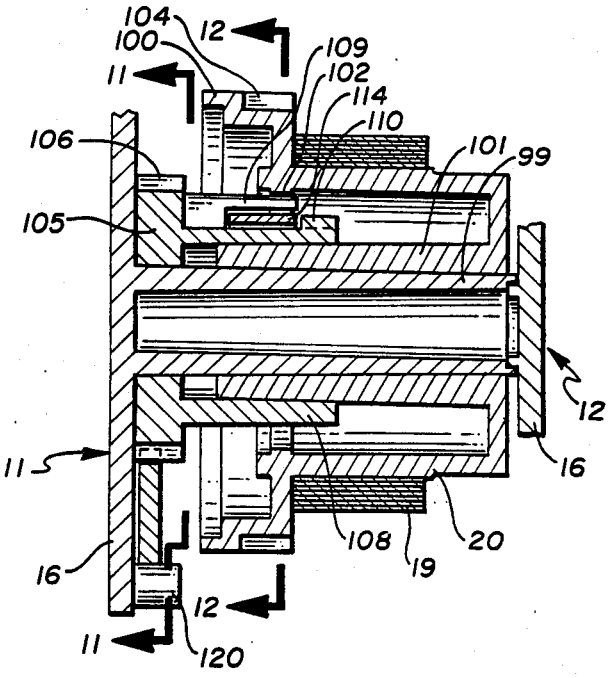
FIG. 10 is a sectional view of the ribbon rewind means as viewed along the section line 10—10 of FIG. 2.
Figure 11:
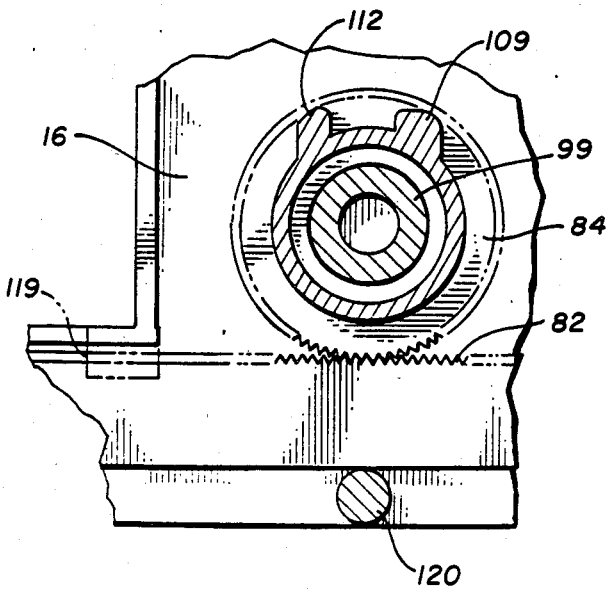
FIG. 11 is a sectional view of the ribbon rewind means as viewed along the section line 11—11 of FIG. 10.
Figure 12:
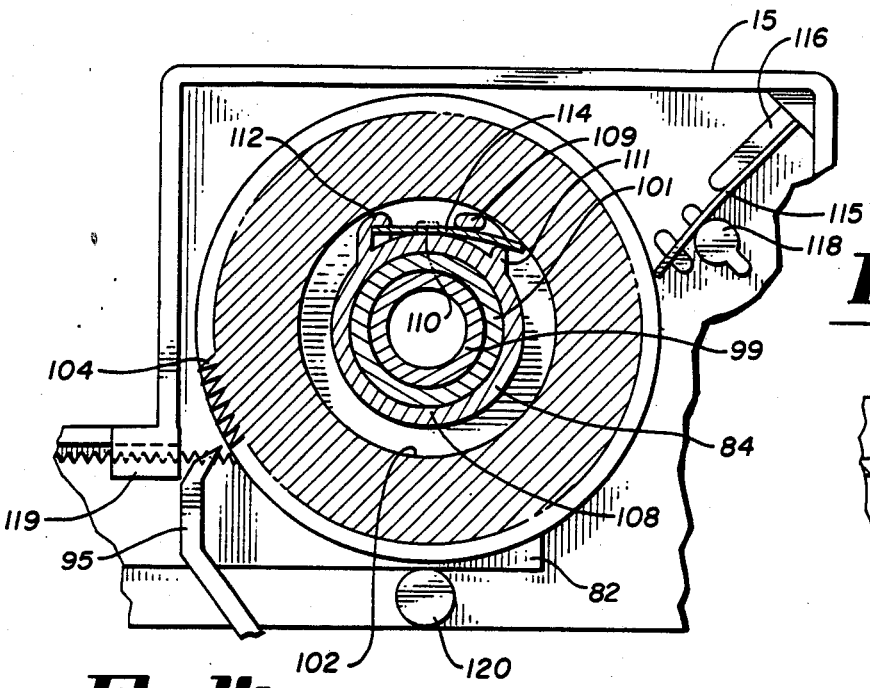
FIG. 12 is a sectional view of the ribbon rewind means as viewed along the section line 12—12 of FIG. 10.

As illustrated best in FIGS. 10, 11 and 12, the cylindrical section 108 is provided with a plurality of leaf spring support members 109, 110, 111 and 112 which support a leaf spring 114. The outer end of the spring 114 is adapted for engagement with an annular rib 102 formed on an inside surface of the rewind spool 20. The leaf spring 114 is positioned to permit rotational movement of the clutch member 84 in a counterclockwise direction with respect to the rewind spool 20 (as viewed in FIG. 12), but to preclude clockwise movement of the member 84 relative to the spool 20. As a result, rotational movement of the clutch member 84 in a clockwise direction as viewed in FIGS. 2 and 12 results in corresponding clockwise movement of the ribbon rewind spool 20 because of engagement between the leaf spring 114 and the annular rib 102. However, counterclockwise rotation of the clutch member 84 will not cause similar movement of the rewind spool 20 because of the direction in which the leaf spring 114 is positioned and because of the existence of the leaf spring 115 (FIG. 2) preventing counterclockwise rotation of the spool 20.

Rotational movement of the member 84 is caused by engagement between the ratchet teeth on the arm 82 and the ratchet teeth 106 on the base portion 105. As the drive arm 82 moves toward the left as viewed in FIGS. 11 and 12, the clutch member 84 and thus the ribbon rewind spool 20 are caused to move in a clockwise direction. Movement of the drive arm 82 toward the right causes counterclockwise movement of the clutch member 84 but no corresponding movement of the ribbon rewind spool 20. The drive arm 82 is supported by the post 120 and the retaining tab 119.

Having described the structure of the preferred embodiment of the present invention in detail, the operation can be understood as follows. When the cartridge is out of the machine, the shuttle assembly 22 is in its forward position and retained there as a result of engagement between an outer portion of the tape guide tab 92 and the recessed portion 81 of the arm 54. In this position, the tab 90 of the tape and ribbon guide means 24 extends outwardly beyond the side wall of the housing section 11. As the cartridge is inserted into the machine, the shuttle drive arm 125 is guided between the rocker drive tabs 70, 70 and into the drive arm cavity by the guide members 72, 72. At the same time, the positioning tab 37 is guided into the slot 23 by the guide surfaces 27 (FIG. 13) and the locating portions **47*a* snap into the openings 17 (FIG. 14). This biases the cartridge toward the rear panel 98 of the machine (FIG. 8). Also, as the cartridge is inserted into the machine, the tape guide alignment tab 90 engages the rear frame member 98 of the machine, thus forcing the tape guide member 89 inwardly to center the tape 18 with respect to the machine. Insertion of the cartridge also results in the tape sensing mechanism 57 being inserted through the opening 43 in the bottom of the cartridge and into engagement with the tape 18 and positioning of the stop arm 126 in a position forward of the stop surface 73**.

As a lettering cycle is initiated, the shuttle assembly is in its forwardmost position as shown in FIG. **5*a* with the forward wall portion 73 in contact with the stop arm 126. As the cycle begins, the print bar 130 moves upwardly toward the force resisting means 129. During this upward movement, a portion of the print bar 130 (FIG. 2) engages the tape guide tab 92 and moves the same upwardly. Such upward movement also causes the ratchet arm 95 to engage the teeth on the rewind spool 20, thus causing a slight rotation of the spool. Continued upward movement of the print bar 130 creates a force between the print bar 130 and the character on the periphery of the font 128. This causes an image of the character to be transferred from the ribbon 19 to the tape 18 or a character to be cut from a layer of the tape. During the above described lettering step, the shuttle drive arm 125 will begin its rearward movement. Initial rearward movement will cause the rocker assembly 69 to pivot in a counterclockwise direction about the pivot 64, thereby releasing the gripping force of the leaf spring 75 with respect to the tape 18. Further rearward movement of the drive arm 125 will result in rearward movement of the entire shuttle assembly 22. Because of the existence of the leaf spring 51, the tape 18 will remain stationery. The rearward movement of the shuttle assembly 22 will be limited as a result of engagement between the index tab 58 and an index or spacing ring 131 on the inside surface of the font. The drive arm 125 will then reverse directions, thereby moving in a forward direction to advance the tape 18 toward the lettering station. During initial forward movement of the drive arm 125, the rocker assembly 69 pivots in a clockwise direction about the pivot 64, thereby causing increased gripping engagement between the leaf spring 75 and the tape 18. Further forward movement of the drive arm 125 results in the entire shuttle assembly and therefore tape 18 being advanced to a point which is limited by engagement of the surface 73 with the stop arm 126. During this forward movement of the shuttle, the ribbon rewind drive arm 82 moves in a forward direction as well, thereby causing generally clockwise rotational movement of the cylindrical clutch 84 and corresponding clockwise rotation of the ribbon rewind spool 20. This rotation of the spool 20 pulls printed ribbon 19** from the ribbon supply spool.

Although the description of the preferred embodiment has been quite specific, it is contemplated that various changes could be made without deviating from the spirit of the present invention. Accordingly, it is intended that the scope of the present invention be dictated by the appended claims rather than by the description of the preferred embodiment.

We claim:

1. A tape supply cartridge for supplying tape to a lettering apparatus comprising:

a cartridge housing having a pair of parallel side walls connected by a peripheral edge wall;

a supply of tape within said housing;

advancement means for advancing said tape along a tape advancement path in a direction generally parallel to said side walls into letttering alignment with said apparatus; and a tape guide fixedly supported within said housing and including a laterally extending tape guide element having a pair of laterally spaced tape guide tabs having tape guide edges, said tape guide adapted for limited lateral movement relative to said side walls in a direction generally perpendicular to said side walls, said tape guide further including a centering tab having a portion extending laterally outwardly past one of said side walls in a direction generally perpendicular to said one side wall for engagement with a reference surface on said apparatus, said centering tab being connected with said tape guide element such that lateral movement of said centering tab correspondingly causes said limited lateral movement of said tape guide element.

2. The cartridge of claim 1 wherein said centering tab is prestressed such that said tab is biased outwardly past one of said side walls.

3. The cartridge of claim 1 wherein said pair of laterally spaced tape guide tabs include a reference edge and a bias edge biasing said tape toward said reference edge.

4. The cartridge of claim 3 wherein said bias edge includes an elongated flexible member having one end connected with said tape guide element and a free end adapted for engagement with an edge of said tape.

5. The cartridge of claim 4 wherein said flexible member is prestressed so as to bias said tape toward said reference edge.

6. The cartridge of claim 1 including a supply of ribbon and ribbon guide means comprising a laterally extending ribbon guide element connected with said tape guide element.

7. The cartridge of claim 6 wherein said ribbon guide element includes a ribbon guide opening and wherein said ribbon guide opening is positioned between said tape guide tabs.

8. The cartridge of claim 1 including a supply of ribbon within said housing and a ribbon rewind spool having a plurality of ratchet teeth along a peripheral edge and wherein said tape guide includes a ratchet drive arm for engagement with said plurality of ratchet teeth.

9. The cartridge of claim 1 including an opening in said peripheral edge wall of said housing along the bottom of said cartridge for insertion of a tape sensing element.

10. The cartridge of claim 9 wherein said tape sensing element includes a pair of electrical contact members for engaging said supply of tape and wherein said supply of tape includes a conductive portion near the end of said supply of tape for engagement by said electrical contact members.

11. The cartridge of claim 1 for supplying tape to a printing station of a lettering apparatus including:

a ribbon supply within said housing;

a ribbon rewind housing portion disposed above said tape advancement path; and means within said ribbon rewind housing portion for supporting said tape guide.

* * * * *